US008717397B2

(12) United States Patent
Suzuki et al.

(10) Patent No.: US 8,717,397 B2
(45) Date of Patent: May 6, 2014

(54) THERMAL TRANSFER SHEET

(75) Inventors: Tomoko Suzuki, Sayama (JP); Yoshimasa Kobayashi, Kawaguchi (JP); Kano Sakamoto, Higashikurume (JP); Shinya Yoda, Tokorozawa (JP); Mitsuhiro Oota, Tokorozawa (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 13/814,574

(22) PCT Filed: Aug. 25, 2010

(86) PCT No.: PCT/JP2010/064404

§ 371 (c)(1),
(2), (4) Date: Feb. 6, 2013

(87) PCT Pub. No.: WO2012/017564

PCT Pub. Date: Feb. 9, 2012

(65) Prior Publication Data

US 2013/0135417 A1 May 30, 2013

(30) Foreign Application Priority Data

Aug. 6, 2010 (JP) ..... 2010-177723

(51) Int. Cl.
*B41M 5/40* (2006.01)
*B41M 5/382* (2006.01)

(52) U.S. Cl.
USPC ..... 347/217

(58) Field of Classification Search
USPC ..... 347/217
See application file for complete search history.

(56) References Cited

FOREIGN PATENT DOCUMENTS

| | | | | |
|---|---|---|---|---|
| JP | 05-185758 A1 | | 7/1993 | |
| JP | 2001-001653 A1 | | 1/2001 | |
| JP | 2007-030504 A1 | | 2/2007 | |
| JP | 2010-194881 | * | 9/2010 | ..... B41M 5/382 |
| JP | 2010-253837 | * | 11/2010 | ..... B41M 5/382 |

OTHER PUBLICATIONS

Computer-generated translation of JP 2007-030504, published on Feb. 2007.*
Computer-generated translation of JP 2001-001653, published on Jan. 2001.*
Computer_generated translation of JP 05-185758, pulblished on Jul. 1993.*
International Search Report and Written Opinion dated Sep. 28, 2010.

* cited by examiner

*Primary Examiner* — Huan Tran
(74) *Attorney, Agent, or Firm* — Burr & Brown, PLLC

(57) ABSTRACT

There is provided a thermal transfer sheet that, by virtue of flexibility and heat resistance imparted by a primer layer constituting the thermal transfer sheet, is less likely to be broken even upon exposure to a high level of thermal energy and is highly suitable for high-speed printing. The thermal transfer sheet has a thermally transferable colorant layer provided on one surface of a base material sheet, and a heat-resistant slipping layer provided on the other surface of the base material sheet through a primer layer. The primer layer contains at least a polyvinyl alcohol resin and a crosslinking agent.

12 Claims, 1 Drawing Sheet

THERMAL TRANSFER SHEET

BACKGROUND OF THE INVENTION

1. Field of the Invention

Dye sublimation thermal transfer sheets comprising a base material sheet formed of a polyester film or the like and a sublimable dye-containing thermally sublimable colorant layer provided on one surface of the base material sheet and heat fusion thermal transfer sheets having the same construction as the dye sublimation thermal transfer sheets except that a fusion-transferable colorant layer comprising a thermally fusible composition containing a colorant is provided instead of the thermally sublimable colorant layer are known as thermal transfer sheets for image formation using thermal transfer. In these thermal transfer sheets, it is common practice to provide a heat-resistant slipping layer on a surface of the base material sheet remote from the colorant layer or to provide a primer layer between the base material sheet and the heat-resistant slipping layer, from the viewpoint of preventing fusion between a base material sheet and a thermal head.

An increase in printing speed in recent printers has led to a tendency toward a more and more increase in heat energy emitted from the thermal head, leading to problems derived from fusion between the heat-resistant slipping layer and the thermal head, for example, sticking, print cockles, and ribbon breakage. An attempt to impart further improved heat resistance to the heat-resistant slipping layer has been made in order to realize high speed printing in printers. However, it has been found that, when the conventional primer layer is used, the primer layer is softened by heat energy, resulting in print defects as a result of flow of the heat-resistant slipping layer, making it impossible to satisfactorily develop properties of the heat-resistant slipping layer.

2. Description of Related Art

For example, Japanese Patent Application Laid-Open No. 1653/2001 (patent document 1) discloses a thermal transfer sheet comprising a primer layer containing a sulfonated polyaniline as an antistatic agent and a resin having given viscosity and elasticity as a primer component. The claimed advantage of the thermal transfer sheet is that cockling of the thermal transfer sheet caused by heat damage of the primer layer during printing can be prevented by maintaining a high viscoelasticity of the primer layer under elevated temperature conditions.

In the thermal transfer sheet described in patent document 1, however, it is difficult to say that the thermal transfer sheet can satisfactorily withstand heat energy that is emitted from the thermal head and has been increased due to an increase in printing speed of recent printers. Accordingly, the development of thermal transfer sheets having higher heat resistance has been desired.

PRIOR ART DOCUMENT

Patent Document

Patent document 1: Japanese Patent Application Laid-Open No. 1653/2001

SUMMARY OF THE INVENTION

Problems to be Solved by the Invention

In order to solve the above problems, the present inventors have made extensive and intensive studies and, as a result, have found that a flexible and heat-resistant primer layer can be formed by using a polyvinyl alcohol resin and a crosslinking agent as materials for the primer layer. The present inventors have further found that the thermal transfer sheet comprising the primer layer is less likely to undergo breaking and the like even when a high heat energy is applied during high-speed printing. Accordingly, an object of the present invention is to provide a thermal transfer sheet that, even when a high heat energy is applied, is less likely to undergo breaking by imparting flexibility and heat resistance to the primer layer constituting the thermal transfer sheet and is highly suitable for high-speed printing.

Means for Solving the Problems

According to the present invention, there is provided a thermal transfer sheet comprising: a base material sheet; a thermally transferable colorant layer provided on one surface of the base material sheet; and a heat-resistant slipping layer provided on the other surface of the base material sheet through a primer layer, wherein the primer layer contains a polyvinyl alcohol resin and a crosslinking agent.

Effect of the Invention

According to the present invention, a flexible and heat-resistant primer layer can be formed by using a polyvinyl alcohol resin and a crosslinking agent as materials for the primer layer constituting the thermal transfer sheet. Consequently, breaking of the thermal transfer sheet during high-speed printing can be prevented by imparting flexibility and heat resistance to the primer layer.

DETAILED DESCRIPTION OF THE INVENTION

The present invention will be described in more detail.

Figure 1:
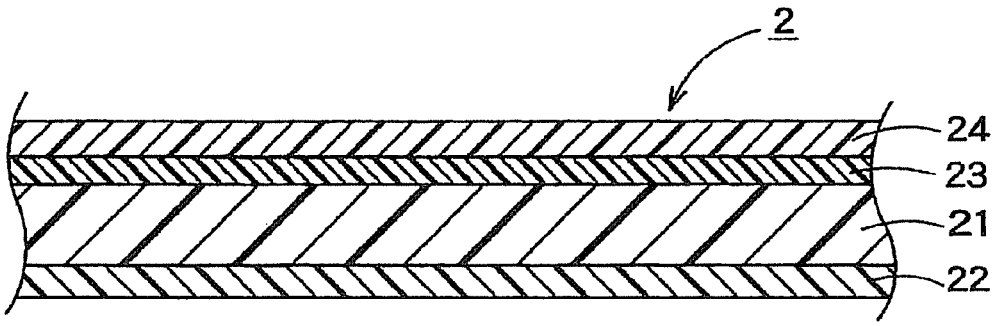
FIG. 1 is a schematic cross-sectional view of a thermal transfer sheet.
Figure 2:
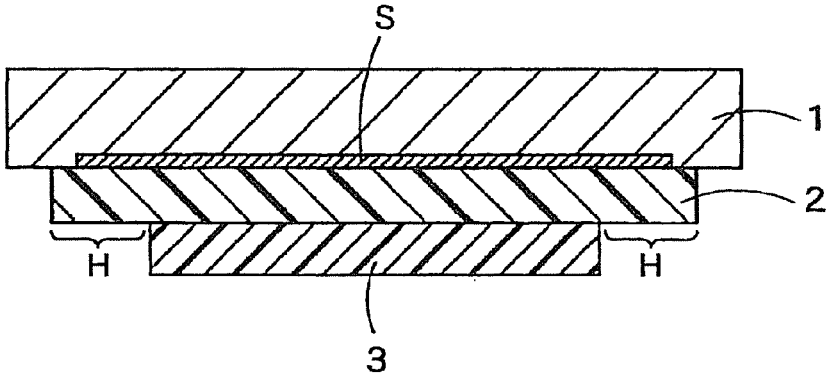
FIG. 2 is a diagram showing a breakage evaluation site of a thermal transfer sheet.

As shown in FIG. 1, the thermal transfer sheet according to the present invention has a layer construction comprising a base material sheet 21, a thermally transferable colorant layer 22 provided on one surface of the base material sheet 21, and a heat-resistant slipping layer 24 provided on the other surface of the base material sheet 21 through a primer layer 23.

In the present invention, the primer layer 23 contains a polyvinyl alcohol resin and a crosslinking agent as indispensable components from the viewpoint of imparting flexibility, viscoelasticity, strength, heat resistance and the like to the primer layer 23. Individual layers constituting the thermal transfer sheet will be described.

[Base Material Sheet]

Materials for the base material sheet constituting the thermal transfer sheet according to the present invention may be one that has hitherto been known in the art. Other materials having a certain degree of heat resistance and strength may also be used. Examples of materials for the base material sheets include films of resins such as polyethylene terephthalates, polyesters, polypropylenes, polycarbonates, polyethylenes, polystyrenes, polyvinyl alcohols, polyvinyl chlorides, polyvinylidene chlorides, polyimides, nylons, cellulose acetate, ionomers and the like; papers such as capacitor papers and paraffin papers; and nonwoven fabrics. They may be used solely or as a laminate of any combination of them. Among them, polyethylene terephthalate is preferred that is a general-purpose plastic which can form a thin film and is inexpensive.

The thickness of the base material sheet may be properly selected depending upon materials so that the base material sheet has proper strength, heat resistance and the like. In general, however, the thickness of the base material sheet is preferably approximately 0.5 to 50 μm, more preferably 1 to 20 μm, still more preferably 1 to 10 μm.

The base material sheet may have been subjected to surface treatment from the viewpoint of improving adhesion to adjacent layers. Examples of such surface treatment include publicly known resin surface modification techniques such as corona discharge treatment, flame treatment, ozone treatment, ultraviolet treatment, radiation treatment, roughening treatment, chemical treatment, plasma treatment, and grafting treatment. Only one of the surface treatment methods may be carried out, or alternatively, two or more of the surface treatment methods may be carried out. In the present invention, among the surface treatment methods, corona treatment or plasma treatment is preferred from the viewpoints of suitability for the manufacture of surface treated base material sheets and low cost.

[Thermally Transferable Colorant Layer]

In the thermal transfer sheet according to the present invention, a thermally transferable colorant layer is provided on one surface of the base material sheet. When the thermal transfer sheet is a dye sublimation thermal transfer sheet, a sublimable dye-containing layer is formed as the thermally transferable colorant layer. On the other hand, when the thermal transfer sheet is a heat-fusion thermal transfer sheet, a layer containing a heat-fusible ink formed of a coloring agent-containing heat-fusion composition is formed as the thermally transferable colorant layer. In the thermal transfer sheet according to the present invention, sublimable dye-containing layer areas and layer areas containing a heat-fusible ink formed of a coloring agent-containing heat-fusion composition may also be provided face-serially on a piece of a continuous base material sheet. An embodiment where the thermal transfer sheet is a dye sublimation thermal transfer sheet will be described as a typical example. However, it should be noted that the present invention is not limited to the dye sublimation thermal transfer sheet only.

Dyes that have hitherto been publicly known may be used as materials for the thermally transferable colorant layer. Preferred are dyes that have good properties as printing materials, for example, dyes that have a satisfactory color density and undergo neither color change nor fading upon exposure to light, heat, temperature and the like. Examples of such dyes include red dyes, for example, MS Red G (manufactured by Mitsui Toatsu Chemicals, Inc.), Macrolex Red Violet R (manufactured by Bayer), CeresRed 7B (manufactured by Bayer), and Samaron Red F3BS (manufactured by Mitsubishi Chemical Corporation), yellow dyes, for example, Phorone Brilliant Yellow 6GL (manufactured by Clariant Corp.), PTY-52 (manufactured by Mitsubishi Kasei Corp.), and Macrolex Yellow 6G (manufactured by Bayer), and blue dyes, for example, Kayaset Blue 714 (manufactured by Nippon Kayaku Co., Ltd.), Waxoline Blue AP-FW (manufactured by ICI), Phorone Brilliant Blue S-R (manufactured by Sandoz K.K.), and MS Blue 100 (manufactured by Mitsui Toatsu Chemicals, Inc.).

Binder resins that support the dyes include, for example, cellulosic resins such as ethylcellulose resins, hydroxyethylcellulose resins, ethylhydroxycellulose resins, methylcellulose resins, and cellulose acetate resins, vinyl resins such as polyvinyl alcohol resins, polyvinyl acetate resins, polyvinyl butyral resins, polyvinyl acetal resins, and polyvinyl pyrrolidone, acrylic resins such as poly(meth)acrylates and poly(meth)acrylamides, polyurethane resins, polyamide resins, and polyester resins. Among them, cellulosic, vinyl, acrylic, polyurethane, polyester or other resins are preferred from the viewpoints of heat resistance, dye transferability and the like.

The thermally transferable colorant layer may be formed, for example, by the following method. Specifically, the thermally transferable colorant layer may be formed by optionally adding additives such as release agents to the above dyes and binder resins, dissolving the mixture in a suitable organic solvent such as toluene or methyl ethyl ketone or dispersing the mixture in water to prepare a coating liquid (a solution or dispersion) for thermally transferable colorant layer formation, coating the coating liquid on one surface of a base material sheet by a forming means such as gravure printing, reverse roll coating using a gravure plate, roll coating, or bar coating, and drying the coating. Preferably, the thermally transferable colorant layer has a thickness of about 0.2 to 5.0 μm and has a sublimable dye content of 5 to 90% by weight, more preferably 5 to 70% by weight.

[Protective Layer]

In the thermal transfer sheet according to the present invention, a protective layer may be provided face-serially on the surface on which the thermally transferable colorant layer is provided. After the transfer of the colorant on a thermal transfer image-receiving sheet, the protective layer is transferred to cover the image, whereby the image can be protected against light, gases, liquids, scratching and the like.

[Heat-Resistant Slipping Layer]

A heat-resistant slipping layer is provided through a primer layer on a surface of the base material sheet remote from the surface on which the thermally transferable colorant layer is provided. The heat-resistant slipping layer refers to a layer that is provided on a surface of the base material sheet remote from the surface on which the thermally transferable colorant layer is provided (on the surface that comes into contact with a thermal head) from the viewpoint of preventing fusion between the base material sheet and the thermal head to realize smooth running of the thermal head. The heat-resistant slipping layer contains a heat-resistant binder resin and a thermal release agent or a substance that functions as a lubricant as basic constituents. The binder resin for heat-resistant slipping layer formation is not particularly limited, and any conventional publicly known resin may be used. Examples thereof include polyvinyl acetal resins, polyvinyl acetoacetal resins, polyester resins, polyacrylic ester resins, polyurethane resins, polyacrylate resins, polyamide resins, polycarbonate resins, polyether resins, and cellulosic resins.

In particular, in the present invention, when the thermal transfer sheet is manufactured in an in-line process, that is, when the thermal transfer sheet is continuously manufactured by forming, simultaneously with the formation of the primer layer and the heat-resistant slipping layer on one surface of the base material sheet, the thermally transferable colorant layer on the other surface of the base material sheet, resins that contain a hydroxyl-containing thermoplastic resin having a hydroxyl group value of not less than 9% by weight and a polyisocyanate resin, the molar ratio of the number of isocyanate groups in the polyisocyanate resin to the number of hydroxyl groups in the hydroxyl-containing thermoplastic resin, that is, —NCO/—OH, being in the range of 0.3 to 2.0, are preferred as the binder resin. The term "hydroxyl group value" of the hydroxyl-containing thermoplastic resin as used herein means the proportion of the hydroxyl group-containing monomer component in the resin polymer and is a value calculated as a proportion (% by weight) of weight of the hydroxyl group-containing monomer component to the weight of the whole resin polymer.

As described above, in the manufacturing process of the thermal transfer sheet, when a sheet including a heat-resistant slipping layer provided on one surface of a base material sheet is prepared followed by the formation of a thermally transferable colorant layer on a surface of the base material sheet remote from the surface on which the heat-resistant slipping layer is formed (that is, when a thermal transfer sheet is manufactured offline), since plenty of time can be taken for the formation of the heat-resistant slipping layer, a mixture composed of a polyvinyl butyral resin and a polyisocyanate resin has hitherto been used as the resin binder for constituting the heat-resistant slipping layer. When a thermally transferable colorant layer is formed, after or simultaneously with the formation of the heat-resistant slipping layer on one surface of the base material sheet, on a surface of the base material sheet remote from the surface on which the heat-resistant slipping layer is formed (that is, the thermal transfer sheet is manufactured in an in-line process), since the binder resin in the heat-resistant slipping layer should be satisfactorily cured in a short time, polyamide-imide resins, polyamide-imide silicone resins have been used as described in Japanese Patent Application Laid-Open No. 132089/2009. When polyamide resins are used as the binder, in some cases, heat resistance is sometimes unsatisfactory depending upon the temperature of heating by the thermal head during printing.

When the thermal transfer sheet is stored in a roll form, the silicone component sometimes bleeds out from the heat-resistant slipping layer, and the so-called kicked back phenomenon sometimes occurs in which the dye is transferred from the colorant layer to the heat-resistant slipping layer and is retransferred to other color portions of the colorant layer. In the present invention, even when the thermal transfer sheet is manufactured in an in-line process, the use of the binder resin can provide a thermal transfer sheet having high heat resistance and a combination of the binder resin with the specific lubricant can suppress the occurrence of kicked back even when the thermal transfer sheet is stored in a roll form.

Hydroxyl-containing thermoplastic resins usable as the binder include cellulosic resins such as ethylcellulose, hydroxyethylcellulose, ethyl hydroxyethylcellulose, hydroxypropylcellulose, methylcellulose, acetylcellulose, cellulose acetate butyrate, and nitrocellulose, vinyl resins such as polyvinyl alcohol, polyvinyl pyrrolidone, polyethyl methacrylate, polyacrylamides, and acrylonitrile-styrene copolymers, polyvinyl acetal resins such as polyvinyl butyral resins and polyacetoacetal resins, polyamide-imide resins, polyurethane resins, silicone-modified or fluoro urethane resins, and acrylic resins. Among them, polyvinyl acetal resins such as polyvinyl butyral resins and polyacetoacetal resins that contain a number of hydroxyl groups in their molecule are suitable for use.

In particular, in polyvinyl acetal resins, polyvinyl acetal used in the conventional offline manufacture, when applied to in-line manufacture, sometimes provides a thermal transfer sheet having unsatisfactory heat resistance. By contrast, the use of a hydroxyl-containing thermoplastic resin having a hydroxyl group value of not less than 9% by weight can contribute to a significant improvement in heat resistance of the thermal transfer sheet. In the present invention, the hydroxyl group value of the hydroxyl-containing thermoplastic resin is preferably not more than 25% by weight. When the hydroxyl group value of the polyvinyl acetal is more than 25% by weight, the resin is less likely to be dissolved in solvents for binder resin dissolution, such as ethyl acetate, toluene, and methyl ethyl ketone. Specific examples of polyvinyl acetal resins having a hydroxyl group value of 9 to 25% by weight include #3000-1, #3000-2, #3000-4, #3000-K, #4000-1, and #4000-2 manufactured by Denki Kagaku Kogyo K.K.

Polyisocyanate resins usable as the curing agent crosslink the hydroxyl-containing thermoplastic resin by taking advantage of the hydroxyl group to improve the coating film strength or heat resistance of the heat-resistant slipping layer. Various conventional polyisocyanates are known. Among them, adducts of aromatic isocyanates are preferred. Aromatic polyisocyantes include 2,4-toluene diisocyanate, 2,6-toluene diisocyanate, a mixture of 2,4-toluene diisocyanate with 2,6-toluene diisocyanate, 1,5-naphthalene diisocyanate, tolidine diisocyanate, p-phenylene diisocyanate, trans-cyclohexane, 1,4-diisocyanate, xylylene diisocyanate, triphenylmethane triisocyanate, and tris(isocyanate phenyl) thiophosphate. 2,4-Toluene diisocyanate, 2,6-Toluene diisocyanate, or a mixture of 2,4-toluene diisocyanate with 2,6-toluene diisocyanate is preferred.

The polyisocyanate is added in such an amount that the molar ratio of the number of isocyanate groups in the polyisocyanate to the number of hydroxyl groups in the hydroxyl-containing thermoplastic resin, that is, —NCO/—OH, is in the range of 0.3 to 2.0. When the amount of the polyisocyanate is below the lower limit of the above-defined range, the crosslinking density is so low that the heat resistance is disadvantageously unsatisfactory. On the other hand, when the amount of the polyisocyanate is above the upper limit of the above-defined range, problems occur such as difficulties in regulating shrinkage of the formed coating film, elongated curing time, and the stay of an unreacted isocyanate group in the heat-resistant slipping layer that is reacted with moisture in the air. The suitable amount of the polyisocyanate used is in the range of 5 to 200 parts by weight based on 100 parts by weight of the hydroxyl-containing thermoplastic resin constituting the heat-resistant active layer.

Examples of heat release agents or lubricants that are incorporated in the binder resin include conventional publicly known heat release agents or lubricants, for example, polyethylene waxes, paraffin waxes, metallic soaps, amides of higher fatty acids, esters of higher fatty acids, salts of higher fatty acids, esters of phosphoric acid, silicone oils, silicone-modified polymers, fluoro resins, and molybdenum disulfide. One of or a combination of two or more of them may be used. Among them, polyethylene waxes, metallic soaps, esters of phosphoric acid, and silicone-modified polymers are preferred from the viewpoint of lubricity. When the above hydroxyl-containing thermoplastic resins and polyisocyanate resins are used as the binder resin, the use of metallic soaps as the lubricant is preferred. When metallic soaps are incorporated as a lubricating material, the coefficient of friction between the thermal transfer sheet and the thermal head can be reduced in printing with a medium or high transfer energy. Such metallic soaps include, for example, polyvalent metal salts of alkylphosphoric esters and metal salts of alkylcarboxylic acids. In the present invention, among these metal salts, zinc stearate and/or zinc stearyl phosphate are preferred.

Polyethylene wax particles (powder obtained by pulverizing the polyethylene wax) having a density of 0.94 to 0.97 are suitable. Polyethylene waxes are divided into high-density polyethylene waxes and low-density polyethylene waxes. In the structure of low-density polyethylenes, in many cases, branches are present in an ethylene polymer. On the other hand, the high-density polyethylene is relatively composed mainly of a straight-chain polyethylene structure. A polyethylene wax having a mean particle diameter of not more than 15 μm is suitable, and a polyethylene wax having a mean particle diameter of 7 to 12 μm is particularly suitable. When the particle diameter is excessively small, the function of imparting lubricity to the heat-resistant slipping layer is lowered. On the other hand, when the particle diameter is excessively large, waste is likely to be deposited on the thermal head. The polyethylene wax particles may have spherical, angular, columnar, acicular, plate, irregular or other shapes. In the present invention, the form of spherical particles is preferred from the viewpoint of imparting lubricity to the heat-resistant slipping layer and can allow waste to be less likely to be deposited on the thermal head while imparting excellent lubricity. When the mean particle diameter of the polyethylene wax is in the above-defined range, a high-density polyethylene wax is protruded on the surface of the heat-resistant slipping layer, whereby proper lubricity can be imparted to the thermal transfer sheet.

Preferably, the polyethylene wax particles are incorporated in an amount of 0.5 to 8% by weight based on the total solid content (100% by weight) of the heat-resistant slipping layer. When the content of the polyethylene wax is below the lower limit of the above-defined range, the lubricity of the heat-resistant slipping layer is lowered. On the other hand, when the content of the polyethylene wax is above the upper limit of the above-defined range, waste is likely to be deposited on the thermal head. The melting point of the polyethylene wax is preferably 110 to 140° C. When the melting point is below the lower limit of the above-defined range, the storage stability of the thermal transfer sheet is lowered and, further, the polyethylene wax per se is disadvantageously melted in the step of drying after coating of the heat-resistant slipping layer, leading to a deterioration in lubricity of the heat-resistant slipping layer. On the other hand, when the melting point is above the upper limit of the above-defined range, the transfer of the colorant during the thermal transfer is likely to be uneven due to surface irregularities of the heat-resistant slipping layer. The melting point may be measured by conventional methods, for example, with a differential scanning calorimeter (DSC).

Crosslinking agents may be added to the heat-resistant slipping layer from the viewpoint of improving the adhesion between the heat-resistant slipping layer and the primer layer. The addition of crosslinking agents is effective when a binder resin that does not have desired adhesion to a primer layer which will be described later is selected. Crosslinking agents include, for example, isocyanate crosslinking agents, titanium chelating agents, and titanium alkoxides.

The heat-resistant slipping layer may be formed, for example, by the following method. Specifically, the heat-resistant slipping layer may be formed by optionally adding additives such as crosslinking agents, curing accelerators, lubricants, and fillers to the binder resin, dissolving the binder resin optionally containing the additives in an organic solvent such as toluene, methyl ethyl ketone, methanol, or isopropyl alcohol or dispersing the binder resin optionally containing the additives in water to prepare a coating liquid (a solution or dispersion) for heat-resistant slipping layer formation, coating the coating liquid through a primer layer on a base material sheet by a forming means such as gravure printing, reverse roll coating using a gravure plate, roll coating, or bar coating, and drying and curing the coating. The coverage of the heat-resistant slipping layer is preferably 0.1 to 4.0 g/m$^2$ on solid content basis after drying.

The thickness of the heat-resistant slipping layer is preferably 0.05 to 5 μm, more preferably 0.1 to 1 μm. When the layer thickness is smaller than 0.05 μm, the effect attained as the heat-resistant slipping layer is unsatisfactory. On the other hand, when the layer thickness is larger than 1 μm, the heat transfer from the thermal head to the thermally transferable colorant layer is deteriorated, leading to a drawback of lowered print density. When the heat-resistant slipping layer is provided on the base material sheet, preferably, a crosslinking reaction between the hydroxyl-containing thermoplastic resin and the polyisocyanate is accelerated by heating. When the thermal transfer sheet is manufactured in an in-line process, a method is preferably adopted in which, from the viewpoint of avoiding an influence of heat on the thermally transferable colorant layer, the heat-resistant slipping layer is provided on the base material sheet, followed by the provision of the thermally transferable colorant layer.

[Primer Layer]

The primer layer provided between the heat-resistant slipping layer and the base material sheet contains a polyvinyl alcohol resin and a crosslinking agent as indispensable components. The primer layer refers to a layer that is formed between the heat-resistant slipping layer and the base material sheet from the viewpoints of improving the adhesion between the heat-resistant slipping layer and the base material sheet and further reducing damage to the base material sheet by heat from the thermal head. In the present invention, a primer layer that is excellent in flexibility and heat resistance, as well as in the adhesion to the base material sheet and the heat-resistant slipping layer, can be formed by using a polyvinyl alcohol resin and a crosslinking agent as materials for primer layer. The thermal transfer sheet comprising the primer layer is advantageous in that, even when a high heat energy is applied during high-speed printing, breaking or the like is less likely to occur and the suitability for high-speed printing is high. In the present invention, the term "polyvinyl alcohol resin" means a polymer or a copolymer that not less than 80% by mole of the repeating unit structure is accounted for by vinyl alcohol.

The number average degree of polymerization of the polyvinyl alcohol resin contained in the primer layer is preferably 1000 to 3500. When the number average degree of polymerization of the polyvinyl alcohol resin is in the above-defined range, a primer layer having desired heat resistance and flexibility can be formed. Further, the higher the degree of polymerization, the better the heat resistance. Examples of polyvinyl alcohol resins usable in the primer layer include: polyvinyl alcohols such as Gosenol KH-20 (manufactured by Nippon Synthetic Chemical Industry Co., Ltd.), Gosenol N-300 (manufactured by Nippon Synthetic Chemical Industry Co., Ltd.), Kuraray Poval PVA-235 (manufactured by Kuraray Co., Ltd.), and Kuraray Poval PVA-117 (manufactured by Kuraray Co., Ltd.); Gosefimer Z-200 and Gosefimer Z-320 (manufactured by Nippon Synthetic Chemical Industry Co., Ltd.) that are acetoacetylated polyvinyl alcohols which contains an acetoacetyl group and are highly reactive; and aqueous polyvinyl acetal S-lec KX series (manufactured by Sekisui Chemical Co., Ltd.) and S-lec KW series (manufactured by Sekisui Chemical Co., Ltd.) that an alcohol group in part of polyvinyl alcohol has been modified with acetal. The degree of acetalization of the polyvinyl alcohol is preferably 0 to 20% by mole, more preferably 0 to 11% by mole. The content of the polyvinyl alcohol resin is preferably 20 to 70% by weight, more preferably 30 to 60% by weight, still more preferably 30 to 40% by weight, based on the total solid content of the primer layer. When the content of the polyvinyl alcohol resin is in the above-defined range, the polyvinyl alcohol resin is easy to handle and a primer layer having good flexibility, heat resistance, strength or other properties can be formed.

The crosslinking agent contained in the primer layer is not particularly limited as long as it can crosslink the polyvinyl alcohol resin. Examples of such crosslinking agents include water dispersible isocyanate crosslinking agents, aqueous titanium chelating agents, aluminum chelating agents, zirconyl chloride compounds, glyoxal, trimethylolpropane, and dimethylolurea. Among them, water dispersible isocyanate crosslinking agents, aqueous titanium chelating agents, aluminum chelating agents, and zirconyl chloride compounds are preferred from the viewpoint of imparting excellent flexibility, heat resistance, and strength to the primer layer.

Any of conventional publicly known water dispersible isocyanate crosslinking agents may be used. Examples thereof include toluene diisocyanate (TDI), diphenylmethane diisocyanate (MDI), diphenylmethane diisocyanate, hexamethylene diisocyanate (HDI), isophorone diisocyanate (IPDI), and trimethyl hexamethylene diisocyanate (TMDI). Among them, hexamethylene diisocyanate is preferred because of excellent flexibility. Specifically, commercially available products such as Duranate WB40 (manufactured by Asahi Chemical Industry Co., Ltd.), Duranate WB40 (manufactured by Asahi Chemical Industry Co., Ltd.), and Duranate WT30 (manufactured by Asahi Chemical Industry Co., Ltd.) are usable. The water-dispersible isocyanate refers to a material that, when dispersed in water in an isocyanate group-included state, can stably maintain an active isocyanate group and can stabilize the ink and, upon volatilization of water, can allow the isocyanate group to be reacted with an external resin or the like. The proportion of the isocyanate group (—NCO) to the hydroxyl group (—OH), that is, —OH/—NCO, is preferably in the range of 4/1 to 1/1. When the —OH/—NCO ratio is in the above-defined range, a suitable crosslinking density is obtained and a coating film that has a proper level of elasticity and flexibility and, at the same time, has good adhesion between the base material sheet and the heat-resistant slipping layer can be formed. Further, excess crosslinking agent does not occur, and, thus, problems of occurrence of waste of the thermal head derived from bonding between the crosslinking agents and a lowering in flexibility do not occur.

Suitable commercially available products include Orgatix TC-300, Orgatix TC-310, and Orgatix TC-315 (manufactured by Matsumoto Fine Chemical Co. Ltd.) as an aqueous titanium chelating agent, Alumichelate D (manufactured by Kawaken Fine Chemicals Co., Ltd.) as an aluminum chelating agent, and Orgatix ZB-126 (manufactured by Matsumoto Fine Chemical Co. Ltd.) as a zirconyl chloride compound.

The total content of the polyvinyl alcohol resin and the crosslinking agent is preferably 65 to 100% by weight, more preferably 80 to 100% by weight, based on the total solid content constituting the primer layer. The content of the crosslinking agent is preferably 10 to 75% by weight, more preferably 25 to 60% by weight, based on the total content of the polyvinyl alcohol resin and the crosslinking agent constituting the primer layer. When the content of the crosslinking agent is in the above-defined range, a primer layer having desired flexibility, heat resistance, strength and other properties can be formed. When these crosslinking agents are used, a strong crosslinked structure can be formed by only the step of drying and, thus, the working efficiently of the manufacturing process is excellent.

Preferably, the primer layer contains, in addition to the above components, an aqueous polyurethane or an aqueous polyester. Conventional additives may be used without particular limitation as long as they can impart adhesion to the primer layer. For example, a product commercially available under the trade name of AP-40 (manufactured by DIC) is suitable as the aqueous polyurethane. For example, a product commercially available under the trade name of WR-961 (manufactured by Nippon Synthetic Chemical Industry Co., Ltd.) is suitable as the aqueous polyester. The content of these adhesion imparting agents is preferably 2.5 to 50 parts by weight, more preferably 5 to 30 parts by weight, based on 100 parts by weight in total of the polyvinyl alcohol resin and the crosslinking agent constituting the primer layer. When the content of the adhesion imparting agent is in the above-defined range, a suitable crosslinking density can be obtained and a coating film (a primer layer) that has a proper level of viscoelasticity and flexibility and has good adhesion between the base material sheet and the heat-resistant slipping layer can be formed. Further, excess crosslinking agent does not occur, and, thus, problems of occurrence of waste of the thermal head derived from bonding between the crosslinking agents and a lowering in flexibility do not occur.

Preferably, the primer layer further contains an antistatic agent. Antistatic properties can be imparted to the thermal transfer sheet according to the present invention by incorporating an antistatic agent. For example, fine powders of metal oxides such as tin oxide may be used as the antistatic agent. Further, electrically conductive materials having a it electron conjugated structure, for example, sulfonated polyaniline, polythiophene, and polypyrrole, are also usable.

The primer layer may contain a curing accelerator from the viewpoint of shortening the time necessary for the reaction between the polyol resin and the crosslinking agent. Curing accelerators include tertiary amines.

The primer layer may be formed, for example, by the following method. Specifically, the primer layer may be formed by optionally adding additives such as curing accelerators and antistatic agents to the polyvinyl alcohol resin and the water dispersible isocyanate crosslinking agents, dispersing the mixture in water, coating the resultant coating liquid (dispersion) for primer layer formation by a forming means such as gravure printing, reverse roll coating using a gravure plate, roll coating, or bar coating on a base material sheet, and drying and curing the coating. In addition to water, a mixed solvent composed of an alcohol such as methanol, ethanol, isopropyl alcohol, n-propyl alcohol, or ethylene glycol monobutyl ether and water is also suitable. The coverage of the primer layer is preferably 0.01 to 5.0 g/m$^2$ on a solid content basis after drying. When the coverage of the primer layer is in the above-defined range, a primer layer having good flexibility, heat resistance, strength, and adhesion can be obtained. When the coverage of the primer layer is less than 0.01 g/m$^2$, the adhesion between the primer layer and the base material sheet is unsatisfactory and, at the same time, the antistatic properties of the primer layer are unsatisfactory. Since the heat resistance of the primer layer is not improved proportional to the thickness of the formed primer layer, a coverage of the primer layer of more than 5.0 g/m$^2$ disadvantageously leads to not only lowered cost effectiveness but also lowered thermal conductivity from the thermal head to the thermally transferable colorant layer that in turn causes lowered print density. The upper limit of the coverage of the primer layer is more preferably 1.0 g/m$^2$.

[Other Layers]

As long as the thermal transfer sheet according to the present invention comprises a base material sheet, a thermally transferable colorant layer provided on one surface of the base material sheet, and a heat-resistant slipping layer provided on the other surface of the base material sheet, other layers such as an adhesive layer, a peel layer, a release layer, and an undercoating layer may be provided as the protective layer.

<Method for Image Formation using Thermal Transfer Sheet>

Printing can be carried out using the thermal transfer sheet according to the present invention by heating and pressing a portion corresponding to a printing portion in the thermal transfer sheet from the heat-resistant slipping layer of the base material by a thermal head or the like to transfer the colorant to an object. The printer used in the thermal transfer is not particularly limited, and conventional thermal transfer printers may be used.

When the thermal transfer sheet according to the present invention is a dye sublimation thermal transfer sheet, for example, thermal transfer image-receiving sheets may be used as the object. The thermal transfer image-receiving sheet comprises a dye-receptive layer on one surface of a base material. Individual layers constituting the thermal transfer image-receiving sheet will be described.

The base material layer constituting the thermal transfer image-receiving sheet has a function of holding the receptive layer and preferably has a mechanical strength high enough to pose no problem in handling even in a heated state because heat is applied in thermal transfer. Any material may be used as the material for the base material layer without particular limitation, and examples thereof include capacitor papers, glassine papers, parchment papers, synthetic papers (for example, polyolefin or polystyrene papers), wood free papers, art papers, coated papers, cast coated papers, wall papers, backing papers, synthetic resin- or emulsion-impregnated papers, synthetic rubber latex impregnated papers, synthetic resin internally added papers, board papers, or cellulose fiber papers, resin coated papers that are cellulose papers having obverse and reverse surfaces coated with polyethylene and are used as a base material of photographic papers for silver salt photographs, or films or sheets formed of various plastics such as polyesters, polyacrylates, polycarbonates, polyurethanes, polyimides, polyetherimides, cellulose derivatives, polyethylenes, ethylene-vinyl acetate copolymers, polypropylenes, polystyrenes, acrylic resins, polyvinyl chloride, and polyvinylidene chlorides. Films having microvoids in the inside of a base material (porous films) obtained by adding a white pigment or a filler to these synthetic resins and forming films from the mixture may also be used.

Further, a laminate comprising any combination of the above materials may also be used as the base material layer. Typical examples of such laminates include a laminate of a cellulose fiber paper and a synthetic paper, a laminate of a cellulose fiber paper and a plastic film or sheet. The laminated synthetic paper may have a two-layer structure, or alternatively may have a laminate of three or more layers comprising a cellulose fiber paper (used as a core) and a synthetic paper, a plastic film or a porous film applied to both surfaces of the cellulose fiber paper from the viewpoint of imparting handle or texture. Further, the laminate may be one obtained by providing an empty particle-dispersed resin layer by coating on a surface of a coated paper, a resin coated paper, a plastic film or the like to impart heat insulating properties.

Dry lamination, wet lamination, extrusion and the like may be used without limitation as application methods in the laminates. Methods for stacking the empty-particle layer include, but are not limited to, coating means such as gravure coating, comma coating, blade coating, die coating, slide coating, and curtain coating.

The thickness of the applied base material or the laminated base material may be any one and is generally approximately 10 to 300 μm. When the base material has a poor adhesion to layers formed on the surface thereof, preferably, the surface may be subjected to various primer treatment or corona discharge treatment. When the empty-particle layer is provided, from the viewpoints of adhesion and manufacture efficiency, preferably, the empty-particle layer and the receptive layer or other layer are simultaneously multilayer-coated by slide coating or curtain coating.

The dye-receptive layer provided on the base material layer functions to receive a sublimable dye being transferred from the thermal transfer sheet and to hold the formed image. Resins for receptive layer formation include polycarbonate resins, polyester resins, polyamide resins, acrylic resins, acryl-styrene resins, cellulosic resins, polysulfone resins, polyvinyl chloride resins, vinyl chloride-acrylic resins, polyvinyl acetate resins, vinyl chloride-vinyl acetate copolymer resins, polyvinyl acetal resins, polyvinyl butyral resins, polyurethane resins, polystyrene resins, polypropylene resins, polyethylene resins, ethylene-vinyl acetate copolymer resins, epoxy resins, polyvinyl alcohol resins, gelatin, and derivatives thereof. These resin materials may be used as a mixture of two or more of them.

The thermal transfer image-receiving sheet may contain a release agent in the dye-receptive layer from the viewpoint of improving releasability from the thermal transfer sheet. Release agents include solid waxes such as polyethylene waxes, amide waxes and teflon (registered trademark) powders, fluoro or phosphoric ester surfactants, silicone oils, reactive silicone oils, curable silicone oils or other various modified silicone oils, and various silicone resins. Among them, silicone oils are preferred. The silicone oils may be oily but are preferably curable. Curable silicone oils include reaction curable, photocurable, and catalyst curable silicone oils. Reaction curable and catalyst curable silicone oils are particularly preferred.

The addition amount of these curable silicone oils is preferably 0.5 to 30% by weight of the resin constituting the dye-receptive layer. The release agent layer may also be provided by dissolving or dispersing the release agent in a suitable solvent, coating the solution or dispersion on part of the surface of the receptive layer, and drying the coating. The thickness of the release agent layer is preferably 0.01 to 5.0 μm, particularly preferably 0.05 to 2.0 μm. When the dye-receptive layer is formed using a coating liquid with a silicone oil added thereto, the release agent layer may be formed by curing the silicone oil that has bled out on the surface after coating. In the formation of the dye-receptive layer, pigments or fillers such as titanium oxide, zinc oxide, kaolin, clay, calcium carbonate, and finely divided silica may be added from the viewpoint of improving the whiteness of the dye-receptive layer to further enhance the sharpness of the transferred image. Plasticizers such as phthalic ester compounds, sebacic ester compounds, and phosphoric ester compounds may also be added.

Any of conventional publicly known intermediate layer may be provided between the base material layer and the dye-receptive layer from the viewpoint of imparting the adhesion between the dye-receptive layer and the base material, whiteness, cushioning properties, concealing properties, antistatic properties, curling preventive properties and other properties. Binder resins usable in the intermediate layer include polyurethane resins, polyester resins, polycarbonate resins, polyamide resins, acrylic resins, polystyrene resins, polysulfone resins, polyvinyl chloride resins, polyvinyl acetate resins, vinyl chloride-vinyl acetate copolymer resins, polyvinyl acetal resins, polyvinyl butyral resins, polyvinyl alcohol resins, epoxy resins, cellulosic resins, ethylene-vinyl acetate copolymer resins, polyethylene resins, and polypropylene resins. For resins containing an active hydroxyl group among these resins, isocyanate cured products thereof may be used as the binder.

Preferably, fillers such as titanium oxide, zinc oxide, magnesium carbonate, and calcium carbonate are added to the intermediate layer from the viewpoint of imparting whiteness and concealing properties. Further, stilbene compounds, benzimidazole compounds, benzoxazole compounds and the like may be added as optical brightening agent from the viewpoint of enhancing the whiteness; hindered amine compounds, hindered phenol compounds, benzotriazole compounds, benzophenone compounds and the like may be added as ultraviolet absorbers or antioxidants from the viewpoint of enhancing lightfastness of printed matters; or cationic acrylic resins, polyaniline reins, various conductive fillers and the like may be added from the viewpoint of imparting antistatic properties. The coverage of the intermediate layer is preferably approximately 0.5 to 30 g/m$^2$ on a dry basis.

The resin binder contained in the empty layer is preferably an emulsion comprising a water-insoluble hydrophobic polymer dispersed as fine particles in a water-soluble dispersion medium, or a hydrophilic binder. Such emulsions usable herein include acrylic, polyester, polyurethane, SBR (styrene-butadiene rubber), polyvinyl chloride, polyvinyl acetate, polyvinylidene chloride, and polyolefine emulsions. If necessary, a mixture of two or more of them may also be used. Hydrophilic binders include gelatin and derivatives thereof, polyvinyl alcohols, polyethylene oxide, polyvinyl pyrrolidone, pullulan, carboxymethylcellulose, hydroxyethylcellulose, dextran, dextrin, polyacrylic acid and salts thereof, agar, κ-carageenan, λ-carageenan, ι-carageenan, casein, xanthan gum, locust bean gum, alginic acid, and gum arabic. Gelatin is particularly preferred. The use of such hydrophilic binders can contribute to an improvement in interlayer adhesion between the dye-receptive layer and layers in contact with the dye-receptive layer. In particular, when the layers are formed by aqueous coating and simultaneous multilayer coating methods, the use of gelatin as the binder resin can realize the regulation of each coating liquid in a desired viscosity range that in turn can form a layer having a desired thickness. In the present invention, commercially available gelatin may also be used, and examples of preferred commercially available gelatins include RR, R, and CLV (manufactured by Nitta Gelatin Inc.).

EXAMPLES

The present invention is further illustrated by the following Examples that are not intended as a limitation of the invention. "Parts" in mixing ratio are by weight unless otherwise specified.

Example 1

A coating liquid A for a primer layer was coated by gravure printing (coverage on dry basis: 0.2 g/m$^2$) on one surface of a 4.5 μm-thick polyethylene terephthalate (PET) film, and the coating was dried to form a primer layer. A coating liquid A for a heat-resistant slipping layer was coated by gravure printing (coverage on dry basis: 0.4 g/m$^2$) on the primer layer to form a heat-resistant slipping layer. A coating liquid that is used for undercoating layer formation and has the following composition was then coated on a part of the surface of the base material sheet remote from the heat-resistant slipping layer by a gravure printing machine to a coverage on a dry basis of 0.10 g/m$^2$, and the coating was dried to form an undercoating layer. A coating liquid (Y) that is used for yellow dye layer formation and has the following composition, a coating liquid (M) that is used for magenta dye layer formation and has the following composition, and a coating liquid (C) that is used for cyan dye layer formation and has the following composition each were coated on the undercoating layer to a coverage on a dry basis of 0.6 g/m$^2$, and the coatings were dried to form a thermally transferable colorant layer including a yellow dye layer, a magenta dye layer, and a cyan dye layer that are formed in that order in a face serial manner.

Composition of Coating Liquid A for Primer Layer Formation

| | |
|---|---|
| Polyvinyl alcohol (solid content 100%, degree of polymerization 1700) (Kuraray Poval PVA-117, manufactured by Kuraray Co., Ltd.) | 2.67 parts |
| Ttitanium chlating agent (solid content 42.0%) (Orgatix TC-300, manufactured by Matsumoto Fine Chemical Co. Ltd.) | 2.55 parts |
| Water | 45.89 parts |
| Denatured ethanol | 45.89 parts |

Composition of Coating Liquid A for Heat-Resistant Slipping Layer Formation

| | |
|---|---|
| Polyamide-imide resin (solid content 25%) (HR-15ET, manufactured by Toyobo Co., Ltd.) | 13 parts |
| Polyamide silicone resin (solid content 25%) (HR-14ET, manufactured by Toyobo Co., Ltd.) | 13 parts |
| Silicone oil (KF965-100, manufactured by The Shin-Etsu Chemical Co., Ltd.) | 0.7 part |
| Zinc stearyl phosphate (LBT-1870 (purified product), manufactured by Sakai Chemical Industry Co., Ltd.) | 2.6 parts |
| Zinc setearate (GF-200, manufactured by Nippon Oils & Fats Co., Ltd.) | 2.6 parts |
| Talc (Microace P-3, manufactured by Nippon Talc Co., Ltd.) | 2.6 parts |
| Denatured ethanol | 32.8 parts |
| Toluene | 32.7 parts |

Coating Liquid for Undercoating Layer Formation

| | |
|---|---|
| Alumina sol (solid content 10%) (Alumina sol 200, feather-like form, manufactured by Nissan Chemical Industries Ltd.) | 50 parts |
| Polyvinyl pyrrolidone (K-90, manufactured by ISP)) | 5 parts |
| Water | 25 parts |
| Isopropyl alcohol | 20 parts |

<Coating Liquid (Y) for Yellow Dye Layer Formation>

| | |
|---|---|
| Disperse dye (Disperse Yellow 231) | 2.5 parts |
| Disperse dye (yellow dye A represented by the following chemical formula) | 2.5 parts |
| Binder resin (Polyvinyl acetoacetal resin KS-5, manufactured by Sekisui Chemical Co., Ltd.) | 4.5 parts |
| Polyethylene wax | 0.1 part |
| Methyl ethyl ketone | 45.0 parts |
| Toluene | 45.0 parts |

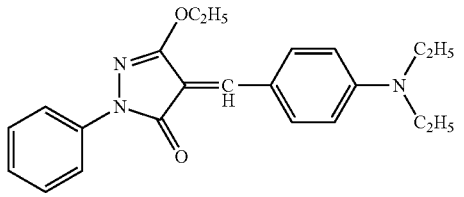

<Coating Liquid (M) for Magenta Dye Layer Formation>

| | |
|---|---|
| Disperse dye (MS Red G) | 1.5 parts |
| Disperse dye (Macrolex Red Violet R) | 2.0 parts |
| Binder resin (Polyvinyl acetoacetal resin KS-5, manufactured by Sekisui Chemical Co., Ltd.) | 4.5 parts |
| Polyethylene wax | 0.1 part |
| Methyl ethyl ketone | 45.0 parts |
| Toluene | 45.0 parts |

<Coating Liquid (C) for Cyan Dye Layer Formation>

| | |
|---|---|
| Disperse dye (Solvent Blue 63) | 2.5 parts |
| Disperse dye (Disperse Blue 354) | 2.5 parts |
| Binder resin (Polyvinyl acetoacetal resin KS-5, manufactured by Sekisui Chemical Co., Ltd.) | 4.5 parts |
| Polyethylene wax | 0.1 part |
| Methyl ethyl ketone | 45.0 parts |
| Toluene | 45.0 parts |

A coating liquid that is used for release layer formation and has the following composition was coated by a gravure printing machine on the surface of the base material sheet remote from the heat slipping layer to a coverage of 1.0 g/m$^2$ in terms of solid content, and the coating was dried to form a release layer. The coating liquid for undercoating layer formation was coated by a gravure printing machine on the release layer to a coverage of 0.10 g/m$^2$ on a dry basis, and the coating was dried to form an undercoating layer. A coating liquid that is used for protective layer formation and has the following composition was coated by a gravure printing machine on the undercoating layer to a coverage of 1.5 g/m$^2$ in terms of solid content, and the coating was dried to form a protective layer. Thus, a thermal transfer sheet was obtained that included a base material layer, a heat-resistant slipping layer provided on one surface of the base material layer and a stack of primer layer/dye layer (Y, M, C) and a stack of a release layer/undercoating layer/protective layer that were provided on the other surface of the base material layer.

<Coating Liquid for Release Layer Formation>

| | |
|---|---|
| Urethane resin (Crisvon 9004, manufactured by DIC) | 20.0 parts |
| Polyvinyl acetoacetal resin (KS-5, manufactured by Sekisui Chemical Co., Ltd.) | 5.0 parts |
| Dimethylformalumide | 80.0 parts |
| Methyl ethyl ketone | 120.0 parts |

<Coating Liquid for Protective Layer>

| | |
|---|---|
| Polyester resin (Vylon 200, manufactured by Toyobo Co., Ltd.) | 69.6 parts |
| Acryl copolymer to which reactive ultraviolet absorber has been reaction-bonded (UVA635L, manufactured by BASF Japan) | 17.4 parts |
| Silica (Sylysia310, manufactured by Fuji Sylysia Chemical Ltd.) | 2.5 parts |
| Methyl ethyl ketone | 20 parts |
| Toluene | 20 parts |

Example 2

A dye sublimation thermal transfer sheet was prepared in the same manner as in Example 1, except that coating liquid B that is used for primer layer formation and has the following composition was used.

Composition of Coating Liquid B for Primer Layer Formation

| | |
|---|---|
| Polyvinyl alcohol (solid content 100%, degree of polymerization 1700) (Kuraray Poval PVA-117, manufactured by Kuraray Co., Ltd.) | 2.14 parts |
| Titanium chelating agent (solid content 42.0%) (Orgatix TC-300, manufactured by Matsumoto Fine Chemical Co. Ltd.) | 5.55 parts |
| Aqueous polyurethane (solid content 22.5%) (Hydran AP-40, manufactured by DIC) | 2.31 parts |
| Water | 45.00 parts |
| Denatured ethanol | 45.00 parts |

Example 3

A dye sublimation thermal transfer sheet was prepared in the same manner as in Example 1, except that coating liquid C that is used for primer layer formation and has the following composition was used.

Composition of Coating Liquid C for Primer Layer Formation

| | |
|---|---|
| Polyvinyl alcohol (solid content 100%, degree of polymerization 1700) (Kuraray Poval PVA-117, manufactured by Kuraray Co., Ltd.) | 1.81 parts |
| Titanium chelating agent (solid content 42.0%) (Orgatix TC-300, manufactured by Matsumoto Fine Chemical Co. Ltd.) | 4.70 parts |
| Aqueous polyurethane (solid content 22.5%) (Hydran AP-40, manufactured by DIC) | 1.94 parts |
| Antistatic agent (solid content 30.4%) (Chemistat 6120, manufactured by Sanyo Kasei Kogyo K.K.) | 2.55 parts |
| Water | 44.50 parts |
| Denatured ethanol | 44.50 parts |

Example 4

A dye sublimation thermal transfer sheet was prepared in the same manner as in Example 1, except that coating liquid D that is used for primer layer formation and has the following composition was used.

Composition of Coating Liquid D for Primer Layer Formation

| | |
|---|---|
| Polyvinyl alcohol (solid content 100%, degree of polymerization 500) (Kuraray Poval PVA-105, manufactured by Kuraray Co., Ltd.) | 2.56 parts |
| Titanium chelating agent (solid content 44.0%) (Orgatix TC-310, manufactured by Matsumoto Fine Chemical Co. Ltd.) | 5.56 parts |
| Water | 45.94 parts |
| Denatured ethanol | 45.94 parts |

Example 5

A dye sublimation thermal transfer sheet was prepared in the same manner as in Example 1, except that coating liquid E that is used for primer layer formation and has the following composition was used.

Composition of Coating Liquid E for Primer Layer Formation

| | |
|---|---|
| Polyvinyl alcohol (solid content 100%, degree of polymerization 1700) (Kuraray Poval PVA-117, manufactured by Kuraray Co., Ltd.) | 2.56 parts |
| Titanium chelating agent (solid content 44.0%) (Orgatix TC-310, manufactured by Matsumoto Fine Chemical Co. Ltd.) | 5.56 parts |
| Water | 45.94 parts |
| Denatured ethanol | 45.94 parts |

Example 6

A dye sublimation thermal transfer sheet was prepared in the same manner as in Example 1, except that coating liquid F that is used for primer layer formation and has the following composition was used.

Composition of Coating Liquid F for Primer Layer Formation

| | |
|---|---|
| Polyvinyl alcohol (solid content 100%, degree of polymerization 2350) (Kuraray Poval PVA-235, manufactured by Kuraray Co., Ltd.) | 2.56 parts |
| Titanium chelating agent (solid content 44.0%) (Orgatix TC-310, manufactured by Matsumoto Fine Chemical Co. Ltd.) | 5.56 parts |
| Water | 45.94 parts |
| Denatured ethanol | 45.94 parts |

Example 7

A dye sublimation thermal transfer sheet was prepared in the same manner as in Example 1, except that coating liquid G that is used for primer layer formation and has the following composition was used.

Composition of Coating Liquid G for Primer Layer Formation

| | |
|---|---|
| Polyvinyl alcohol (solid content 100%, degree of polymerization 1700) (Kuraray Poval PVA-117, manufactured by Kuraray Co., Ltd.) | 2.61 parts |

-continued

| | |
|---|---|
| Aluminum chelating agent (solid content 76.0%) (Alumichelate D, manufactured by Kawaken Fine Chemicals Co., Ltd.) | 3.19 parts |
| Water | 47.10 parts |
| Denatured ethanol | 47.10 parts |

Example 8

A dye sublimation thermal transfer sheet was prepared in the same manner as in Example 1, except that coating liquid H that is used for primer layer formation and has the following composition was used.

Composition of Coating Liquid H for Primer Layer Formation

| | |
|---|---|
| Polyvinyl alcohol (solid content 100%, degree of polymerization 1700) (Kuraray Poval PVA-117, manufactured by Kuraray Co., Ltd.) | 2.94 parts |
| Zirconyl chloride compound (solid content 30.0%) (Orgatix ZB-126, manufactured by Matsumoto Fine Chemical Co. Ltd.) | 6.86 parts |
| Water | 45.10 parts |
| Denatured ethanol | 45.10 parts |

Example 9

A dye sublimation thermal transfer sheet was prepared in the same manner as in Example 1, except that coating liquid I that is used for primer layer formation and has the following composition was used.

Composition of Coating Liquid I for Primer Layer Formation

| | |
|---|---|
| Polyvinyl alcohol (solid content 100%, degree of polymerization 3500) (Kuraray Poval PVA-235, manufactured by Kuraray Co., Ltd.) | 2.00 parts |
| Water-dispersible isocyanate (solid content 100%) (Duranate WT-30, manufactured by Asahi Kasei Chemicals Corporation) | 3.00 parts |
| Water | 95.00 parts |

Example 10

A dye sublimation thermal transfer sheet was prepared in the same manner as in Example 1, except that coating liquid J that is used for primer layer formation and has the following composition was used.

Composition of Coating Liquid J for Primer Layer Formation

| | |
|---|---|
| Polyvinyl alcohol (solid content 100%, degree of polymerization 3500) (Kuraray Poval PVA-235, manufactured by Kuraray Co., Ltd.) | 2.00 parts |
| Water-dispersible isocyanate (solid content 100%) (Duranate WB-40, manufactured by Asahi Kasei Chemicals Corporation) | 3.00 parts |
| Water | 95.00 parts |

Example 11

A dye sublimation thermal transfer sheet was prepared in the same manner as in Example 1, except that coating liquid K that is used for primer layer formation and has the following composition was used.

Composition of Coating Liquid K for Primer Layer Formation

| | |
|---|---|
| Acetoacetylated polyvinyl alcohol (solid content 100%, degree of polymerization 1100) (Gosefimer Z-200, manufactured by Nippon Synthetic Chemical Industry Co., Ltd.) | 2.00 parts |
| Water-dispersible isocyanate (solid content 100%) (Duranate WB-40, manufactured by Asahi Kasei Chemicals Corporation) | 3.00 parts |
| Water | 95.00 parts |

Example 12

A dye sublimation thermal transfer sheet was prepared in the same manner as in Example 1, except that coating liquid L that is used for primer layer formation and has the following composition was used.

Composition of Coating Liquid L for Primer Layer Formation

| | |
|---|---|
| Aqueous polyvinyl acetal (solid content 8%, acetalization 8%) (S-Lec KX-1, manufactured by Sekisui Chemical Co., Ltd.) | 27.13 parts |
| Water-dispersible isocyanate (solid content 100%) (Duranate WB-40, manufactured by Asahi Kasei Chemicals Corporation) | 2.83 parts |
| Water | 70.04 parts |

Example 13

A dye sublimation thermal transfer sheet was prepared in the same manner as in Example 1, except that coating liquid M that is used for primer layer formation and has the following composition was used.

Composition of Coating Liquid M for Primer Layer Formation

| | |
|---|---|
| Polyvinyl alcohol (solid content 100%, degree of polymerization 3500) (Kuraray Poval PVA-235, manufactured by Kuraray Co., Ltd.) | 1.83 parts |
| Water-dispersible isocyanate (solid content 100%) (Duranate WT-30, manufactured by Asahi Kasei Chemicals Corporation) | 2.75 parts |
| Antistatic agent (solid content 30.4%) (Chemistat 6120, manufactured by Sanyo Kasei Kogyo K.K.) | 1.40 parts |
| Water | 94.02 parts |

Example 14

A dye sublimation thermal transfer sheet was prepared in the same manner as in Example 1, except that coating liquid B that is used for heat-resistant slipping layer formation and has the following composition was used.

Composition of Coating Liquid B for Heat-Resistant Slipping Layer Formation

| | |
|---|---|
| Polyvinyl butyral resin (hydroxyl group value 20% by weight) (#3000-4, manufactured by Denki Kagaku Kogyo K.K.) | 6.00 parts |
| Polyisocyanate (solid content 100% by weight, NCO = 17.3% by weight) (Burnock D750-45, manufactured by Dainippon Ink and Chemicals, Inc.) | 8.00 parts |
| Zinc stearyl phosphate (LBT-1830 (purified product), manufactured by Sakai Chemical Industry Co., Ltd.) | 3.00 parts |
| Zinc stearate (SZ-PF, manufactured by Sakai Chemical Industry Co., Ltd.) | 3.00 parts |
| Filler (Microace P-3, manufactured by Nippon Talc Co., Ltd.) | 1.50 parts |
| Polyethylene wax (melting point 110 to 118° C., mean particle diameter 10 μm) (Polywax3000, manufactured by Toyo Petrolite Co., Ltd.) | 3.00 parts |
| Methyl ethyl ketone | 12.58 parts |
| Toluene | 62.92 parts |

Example 15

A dye sublimation thermal transfer sheet was prepared in the same manner as in Example 2, except that coating liquid B that is used for heat-resistant slipping layer formation and has the following composition was used.

Example 16

A dye sublimation thermal transfer sheet was prepared in the same manner as in Example 6, except that coating liquid B that is used for heat-resistant slipping layer formation and has the following composition was used.

Example 17

A dye sublimation thermal transfer sheet was prepared in the same manner as in Example 1, except that coating liquid C that is used for heat-resistant slipping layer formation and has the following composition was used.

Composition of Coating Liquid C for Heat-Resistant Slipping Layer Formation

| | |
|---|---|
| Polyvinyl butyral resin (hydroxyl group value 20% by weight) (#3000-4, manufactured by Denki Kagaku Kogyo K.K.) | 8.53 parts |
| Polyisocyanate (solid content 100% by weight, NCO = 17.3% by weight) (Burnock D750-45, manufactured by Dainippon Ink and Chemicals, Inc.) | 10.97 parts |
| Zinc stearyl phosphate (LBT-1830 (purified product), manufactured by Sakai Chemical Industry Co., Ltd.) | 2.44 parts |
| Zinc stearate (SZ-PF, manufactured by Sakai Chemical Industry Co., Ltd.) | 0.37 part |
| Filler (Microace P-3, manufactured by Nippon Talc Co., Ltd.) | 1.22 parts |
| Polyethylene wax (melting point 110 ~ 118° C., mean particle diameter 10 μm) (Polywax3000, manufactured by Toyo Petrolite Co., Ltd.) | 0.98 part |
| Methyl ethyl ketone | 62.92 parts |
| Toluene | 12.58 parts |

Example 18

A dye sublimation thermal transfer sheet was prepared in the same manner as in Example 2, except that coating liquid C that is used for heat-resistant slipping layer formation and has the following composition was used.

Example 19

A dye sublimation thermal transfer sheet was prepared in the same manner as in Example 6, except that coating liquid C that is used for heat-resistant slipping layer formation and has the following composition was used.

Example 20

A dye sublimation thermal transfer sheet was prepared in the same manner as in Example 1, except that coating liquid D that is used for heat-resistant slipping layer formation and has the following composition was used.

Composition of Coating Liquid D for Heat-Resistant Slipping Layer Formation

| | |
|---|---|
| Polyvinyl butyral resin (hydroxyl group value 20% by weight) (#3000-4, manufactured by Denki Kagaku Kogyo K.K.) | 8.53 parts |
| Polyisocyanate (solid content 100% by weight, NCO = 17.3% by weight) (Burnock D750-45, manufactured by Dainippon Ink and Chemicals, Inc.) | 6.69 parts |
| Zinc stearyl phosphate (LBT-1830 (purified product), manufactured by Sakai Chemical Industry Co., Ltd.) | 1.67 parts |
| Zinc stearate (SZ-PF, manufactured by Sakai Industry Chemical Co., Ltd.) | 1.67 parts |
| Filler (Microace P-3, manufactured by Nippon Talc Co., Ltd.) | 1.98 parts |
| Polyethylene wax (melting point 110 ~ 118° C., mean particle diameter 10 μm) (Polywax3000, manufactured by Toyo Petrolite Co., Ltd.) | 3.96 parts |
| Methyl ethyl ketone | 62.92 parts |
| Toluene | 12.58 parts |

Example 21

A dye sublimation thermal transfer sheet was prepared in the same manner as in Example 2, except that coating liquid D that is used for heat-resistant slipping layer formation and has the following composition was used.

Example 22

A dye sublimation thermal transfer sheet was prepared in the same manner as in Example 6, except that coating liquid D that is used for heat-resistant slipping layer formation and has the following composition was used.

Example 23

A dye sublimation thermal transfer sheet was prepared in the same manner as in Example 1, except that coating liquid E that is used for heat-resistant slipping layer formation and has the following composition was used.

Composition of Coating Liquid E for Heat-Resistant Slipping Layer Formation

| | |
|---|---|
| Polyvinyl butyral resin (hydroxyl group value 11% by weight) (#3000-K, manufactured by Denki Kagaku Kogyo K.K.) | 8.00 parts |
| Polyisocyanate (solid content 100% by weight, NCO = 17.3% by weight) (Burnock D750-45, manufactured by Dainippon Ink and Chemicals, Inc.) | 6.00 parts |
| Zinc stearyl phosphate (LBT-1830 (purified product), manufactured by Sakai Chemical Industry Co., Ltd.) | 3.00 parts |
| Zinc stearate (SZ-PF, manufactured by Sakai Chemical Industry Co., Ltd.) | 3.00 parts |
| Filler (Microace P-3, manufactured by Nippon Talc Co., Ltd.) | 1.50 parts |

-continued

| | |
|---|---|
| Polyethylene wax (melting point 110 ~ 118° C., mean particle diameter 10 μm) (Polywax3000, manufactured by Toyo Petrolite Co., Ltd.) | 3.00 parts |
| Methyl ethyl ketone | 12.59 parts |
| Toluene | 62.92 parts |

Example 24

A dye sublimation thermal transfer sheet was prepared in the same manner as in Example 2, except that coating liquid E that is used for heat-resistant slipping layer formation and has the following composition was used.

Example 25

A dye sublimation thermal transfer sheet was prepared in the same manner as in Example 6, except that coating liquid E that is used for heat-resistant slipping layer formation and has the following composition was used.

Comparative Example 1

A dye sublimation thermal transfer sheet was prepared in the same manner as in Example 1, except that coating liquid N that is used for primer layer formation and has the following composition was used.

Composition of Coating Liquid N for Primer Layer Formation

| | |
|---|---|
| Polyvinyl alcohol (solid content 100%, degree of polymerization 1700) (Kuraray Poval PVA-117, manufactured by Kuraray Co., Ltd.) | 5.00 parts |
| Water | 95.00 parts |

Comparative Example 2

A dye sublimation thermal transfer sheet was prepared in the same manner as in Example 1, except that coating liquid O that is used for primer layer formation and has the following composition was used.

Composition of Coating Liquid O for Primer Layer Formation

| | |
|---|---|
| Polyester (solid content 30.0%) (Vylonal MD-1500, manufactured by Toyobo Co., Ltd.) | 15.10 parts |
| Titanium chelating agent (solid content 44.0%) (Orgatix TC-310, manufactured by Matsumoto Fine Chemical Co. Ltd.) | 0.11 part |
| Water | 42.40 parts |
| Isopropyl alcohol | 42.39 parts |

Comparative Example 3

A dye sublimation thermal transfer sheet was prepared in the same manner as in Comparative Example 1, except that coating liquid B that is used for heat-resistant slipping layer formation and has the following composition was used.

Comparative Example 4

A dye sublimation thermal transfer sheet was prepared in the same manner as in Comparative Example 2, except that coating liquid B that is used for heat-resistant slipping layer formation and has the following composition was used.

Comparative Example 5

A dye sublimation thermal transfer sheet was prepared in the same manner as in Comparative Example 1, except that coating liquid E that is used for heat-resistant slipping layer formation and has the following composition was used.

Comparative Example 6

A dye sublimation thermal transfer sheet was prepared in the same manner as in Comparative Example 2, except that coating liquid E that is used for heat-resistant slipping layer formation and has the following composition was used.

Comparative Example 7

A dye sublimation thermal transfer sheet was prepared in the same manner as in Comparative Example 1, except that coating liquid F that is used for heat-resistant slipping layer formation and has the following composition was used.

Composition of Coating Liquid F for Heat-Resistant Slipping Layer Formation

| | |
|---|---|
| Polyvinyl butyral resin (S-Iec BX-1 manufactured by Sekisui Chemical Co., Ltd.) | 2.0 parts |
| Phosphate ester surfactant (Plysurf A208N, manufactured by Dai-Ichi Kogyo Seiyaku Co., Ltd.) | 1.3 parts |
| Talc (Microace P-3, manufactured by Nippon Talc Co., Ltd.) | 0.3 part |
| Polyisocyanate (Burnock D750-45, manufactured by Dainippon Ink and Chemicals, Inc.) | 9.2 parts |
| Methyl ethyl ketone | 43.6 parts |
| Toluene | 43.6 parts |

Comparative Example 8

A dye sublimation thermal transfer sheet was prepared in the same manner as in Comparative Example 2, except that coating liquid F that is used for heat-resistant slipping layer formation and has the following composition was used.

[Evaluation of Thermal Transfer Sheet: Adhesion]

For thermal transfer sheets, the adhesion between the primer layer and the base material sheet was examined by a peel test (45° peeling) with a pressure-sensitive adhesive tape. A commercially available mending tape (size: 100 mm in length×12 mm in width, manufactured by Nichiban Co., Ltd.) was used as the pressure-sensitive adhesive tape. The adhesion was visually evaluated. Evaluation criteria were as follows.

<Evaluation Criteria>

Score 3: The primer layer was not separated from the base material sheet.

Score 1: The primer layer was separated from the base material sheet.

The thermal transfer sheets prepared above were used in combination with a thermal transfer image-receiving sheet for a dye sublimation printer (CP9000D) manufactured by Mitsubishi Electric Corporation to measure frictional force in printing under the following conditions. Printing and the measurement of the frictional force were carried out with a thermal transfer printer with a frictional force measurement function described in Japanese Patent Application Laid-Open No. 300338/2003.

<Conditions for Printing>

Thermal head: Thermal head manufactured by Toshiba Hokuto Electronics Corporation; head resistance value 5020Ω; resolution 300 dpi (dots per inch)

Line speed: 1 ms/line (resolution in sheet convey direction: 300 lpi (lines per inch)

Pulse duty: 90%

Applied voltage: 30.0 V

Printing pressure: 40 N

Printed image: 1388 pixels in width×945 pixels in length; gradation image of gradations 0 to 255 (1 pixel corresponds to 1 dot).

A blotted image pattern of medium print gradation value (medium density, gradation 125) and a blotted image pattern of a highest print gradation value (high density, gradation 255) were printed under the above conditions. The coefficient of dynamic friction was measured at that time, and the heat resistance was evaluated according to the following criteria.

1: A coefficient of dynamic friction of not less than 0.5

2: A coefficient of dynamic friction of 0.4 (inclusive) to 0.5 (exclusive)

3: A coefficient of dynamic friction of less than 0.4.

[Evaluation of Thermal Transfer Sheet: Durability]

Images having gradation value 255/255 (maximum applied energy: black image) of a thermal transfer image-receiving sheet were printed with Ye, Mg, and Cy dye layers using the thermal transfer sheets obtained above, a thermal transfer image-receiving sheet of a dye sublimation thermal transfer system for a dye sublimation thermal transfer printer (CW-01) manufactured by Citizen Systems Japan Co., Ltd. by a dye sublimation thermal transfer printer (CW-01) manufactured by Citizen Systems Japan Co., Ltd. After printing, whether or not breaking occurred in the thermal transfer sheet was visually inspected. The evaluation criteria were as follows.

1: For the thermal transfer sheet after the printing, considerable breaking and elongation were observed.

2: For the thermal transfer sheet after the printing, breaking was slightly observed, whereas elongation was hardly observed.

3: For the thermal transfer sheet after the printing, breaking was slightly observed, whereas elongation was not observed at all.

4: For the thermal transfer sheet after the printing, neither breaking nor elongation was observed.

[Evaluation of Thermal Transfer Sheet: Back]

For the thermal transfer sheets obtained above, the heat-resistant slipping layer was placed so as to face the magenta dye layer, and a load of 20 kg/cm$^2$ was applied thereto, followed by storage under an environment of a temperature of 40° C. and a humidity of 90% for 96 hr to transfer (kick) the dye in the dye layer to the heat-resistant slipping layer side. The heat-resistant slipping layer was allowed to face the protective layer, and a load of 20 kg/cm$^2$ was applied thereto, followed by storage under an environment of a temperature of 50° C. and a humidity of 20% for 24 hr. Thereafter, the protective layer transfer body on which the dye in the heat-resistant slipping layer had been transferred (backed) was placed on top of an image receiving surface of an image receiving paper (color ink/paper set KP-361P, manufactured by Canon Inc., and transfer was carried out under conditions of 110° C. and 4 mm/sec/line with a laminate tester (Lamipacker LPD2305PRO, manufactured by Fujipla Inc.). The base material sheet was separated from the image receiving paper, and the hue of the transferred portion was measured with GRETAGSpectrolino (light source D65, view angle 2°) manufactured by Gretag. Color difference (ΔE*) was calculated by the following equation, and the results were evaluated according to the following criteria.

$\Delta E^* = ((\text{difference in } L^* \text{ value between before facing and after facing})^2 + (\text{difference in } a^* \text{ value between before facing and after facing})^2 + (\text{difference in } b^* \text{ value between before facing and after facing})^2)^{1/2}$ 1: Color difference ΔE* between transferred product in which unstored protective layer had been transferred and transferred product in which backed protective layer transfer body had been transferred was not less than 3.5.

2: Color difference ΔE* between transferred product in which unstored protective layer had been transferred and transferred product in which backed protective layer transfer body had been transferred was 1.5 (inclusive) to 3.5 (exclusive).

3. Color difference ΔE* between transferred product in which unstored protective layer had been transferred and transferred product in which backed protective layer transfer body had been transferred was less than 1.5

The results of evaluation were as shown in Table 1.

All the dye sublimation thermal transfer sheets comprising a primer layer that comprises a polyvinyl alcohol resin with a water-dispersible isocyanate added thereto (Examples 1, 2, 3, 4, and 5) had good adhesion and heat resistance (flexibility) and were superior in heat resistance (flexibility) to the dye sublimation thermal transfer sheets using a polyester in the primer layer (Comparative Examples 1 and 2). The dye sublimation thermal transfer sheet in which the water-dispersible isocyanate had not been added (Comparative Example 3) was inferior in adhesion and heat resistance (flexibility) to the dye sublimation thermal transfer sheets in which the water-dispersible isocyanate had been added.

DESCRIPTION OF REFERENCE CHARACTERS

1 thermal head
2 thermal transfer sheet
21 base material sheet
22 thermally transferable colorant layer
23 primer layer
24 heat-resistant slipping layer
3 image receiving sheet
H breakage evaluation site
S heating site

TABLE 1

| | | Evaluation of heat resistance | | | | Back |
|---|---|---|---|---|---|---|
| | | Coefficient of Dynamic friction | | | Durability of | (backside- |
| | Adhesion | Medium density area | High density area | Max. print graduation value | thermal transfer sheet | protective layer) |
| Example 1 | 3 | 3 | 3 | 255 | 4 | 2 |
| Example 2 | 3 | 3 | 3 | 255 | 4 | 2 |
| Example 3 | 3 | 3 | 3 | 255 | 4 | 2 |
| Example 4 | 3 | 3 | 3 | 250 | 2 | 2 |
| Example 5 | 3 | 3 | 3 | 255 | 4 | 2 |
| Example 6 | 3 | 3 | 3 | 255 | 4 | 2 |
| Example 7 | 3 | 3 | 3 | 250 | 3 | 2 |
| Example 8 | 3 | 3 | 3 | 250 | 3 | 2 |
| Example 9 | 3 | 3 | 3 | 255 | 4 | 2 |
| Example 10 | 3 | 3 | 3 | 255 | 4 | 2 |
| Example 11 | 3 | 3 | 3 | 255 | 4 | 2 |
| Example 12 | 3 | 3 | 3 | 250 | 3 | 2 |
| Example 13 | 3 | 3 | 3 | 255 | 4 | 2 |
| Example 14 | 3 | 3 | 3 | 255 | 4 | 3 |
| Example 15 | 3 | 3 | 3 | 255 | 4 | 3 |
| Example 16 | 3 | 3 | 3 | 255 | 4 | 3 |
| Example 17 | 3 | 3 | 3 | 255 | 4 | 3 |
| Example 18 | 3 | 3 | 3 | 255 | 4 | 3 |
| Example 19 | 3 | 3 | 3 | 255 | 4 | 3 |
| Example 20 | 3 | 3 | 3 | 255 | 4 | 3 |
| Example 21 | 3 | 3 | 3 | 255 | 4 | 3 |
| Example 22 | 3 | 3 | 3 | 255 | 4 | 3 |
| Example 23 | 3 | 3 | 3 | 250 | 3 | 3 |
| Example 24 | 3 | 3 | 3 | 250 | 3 | 3 |
| Example 25 | 3 | 3 | 3 | 250 | 3 | 3 |
| Comparative Example 1 | 1 | 3 | 2 | 240 | 1 | 2 |
| Comparative Example 2 | 3 | 3 | 2 | 240 | 1 | 2 |
| Comparative Example 3 | 1 | 3 | 2 | 240 | 1 | 3 |
| Comparative Example 4 | 3 | 3 | 2 | 240 | 1 | 3 |
| Comparative Example 5 | 1 | 3 | 2 | 240 | 1 | 3 |
| Comparative Example 6 | 3 | 3 | 2 | 240 | 1 | 3 |
| Comparative Example 7 | 3 | 1 | 2 | 225 | 2 | 1 |
| Comparative Example 8 | 3 | 1 | 2 | 225 | 1 | 1 |

The invention claimed is:

1. A thermal transfer sheet comprising: a base material sheet; a thermally transferable colorant layer provided on one surface of the base material sheet; and a heat-resistant slipping layer provided on the other surface of the base material sheet through a primer layer, wherein the primer layer contains at least a polyvinyl alcohol resin and a crosslinking agent.

2. The thermal transfer sheet according to claim 1, wherein the crosslinking agent is at least one material selected from the group consisting of water dispersible isocyanate crosslinking agents, aqueous titanium chelating agents, aluminum chelating agents, and zirconyl chloride compounds.

3. The thermal transfer sheet according to claim 2, wherein the water dispersible isocyanate crosslinking agent is hexamethylene diisocyanate.

4. The thermal transfer sheet according to claim 1, wherein the polyvinyl alcohol resin has a number average degree of polymerization of 1000 to 3500.

5. The thermal transfer sheet according to claim 1, wherein the primer layer further comprises an aqueous polyurethane and/or an aqueous polyester as an adhesion-imparting agent.

6. The thermal transfer sheet according to claim 1, wherein the primer layer further comprises an antistatic agent.

7. The thermal transfer sheet according to claim 1, wherein the heat-resistant slipping layer comprises at least: a binder resin comprising a hydroxyl-containing thermoplastic resin and a polyisocyanate resin; a lubricant; and a polyethylene wax, the hydroxyl value of the hydroxyl-containing thermoplastic resin is not less than 9% by weight, and the molar ratio between the number of isocyanate groups in the polyisocyanate resin and the number of hydroxyl groups in the hydroxyl-containing thermoplastic resin (—NCO/—OH) is 0.3 to 2.0.

8. The thermal transfer sheet according to claim 7, wherein the hydroxyl-containing thermoplastic resin is a polyvinyl butyral resin and/or a polyvinyl acetal resin.

9. The thermal transfer sheet according to claim 7, wherein the lubricant comprises zinc stearate and zinc stearyl phosphate.

10. The thermal transfer sheet according to claim 7, wherein the heat-resistant slipping layer contains 30 to 90% by weight in terms of solid content of the binder resin.

11. The thermal transfer sheet according to claim 7, wherein the heat-resistant slipping layer contains 5 to 40% by weight in terms of solid content of the lubricant.

12. The thermal transfer sheet according to claim 7, wherein the heat-resistant slipping layer contains 1 to 30% by weight in terms of solid content of the polyethylene wax.

* * * * *